US006889531B2

(12) United States Patent
Benacek et al.

(10) Patent No.: US 6,889,531 B2
(45) Date of Patent: May 10, 2005

(54) METHOD AND DEVICE OF CONTROLLING ELASTIC THREAD

(75) Inventors: Jiri Benacek, Trebic (CZ); Jaroslav Maxa, Trebic (CZ); Petr Machovec, Trebic (CZ); Miroslav Kopecny, Trebic (CZ)

(73) Assignee: Uniplet Trebic, a.s., Trebic (CZ)

( * ) Notice: Subject to any disclaimer, the term of this patent is extended or adjusted under 35 U.S.C. 154(b) by 0 days.

(21) Appl. No.: 10/823,111

(22) Filed: Apr. 13, 2004

(65) Prior Publication Data

US 2004/0221622 A1 Nov. 11, 2004

(30) Foreign Application Priority Data

Apr. 15, 2003 (CZ) ..... PV2003-1061

(51) Int. Cl.[7] ..... D04B 15/50
(52) U.S. Cl. ..... 66/145 S; 66/145 R
(58) Field of Search ..... 66/133, 134, 136, 66/137, 138, 140, 140 S, 141, 142, 143, 145 R, 145 S, 146

(56) References Cited

U.S. PATENT DOCUMENTS 3,766,000 A * 12/1973 Gariboldi ..... 66/9 R
4,967,575 A * 11/1990 Fucik et al. ..... 66/14
5,144,817 A * 9/1992 Tibbals, Jr. ..... 66/140 R
5,251,463 A * 10/1993 Lonati et al. ..... 66/140 R
6,189,345 B1 * 2/2001 Sangiacomo ..... 66/134

* cited by examiner

*Primary Examiner*—Danny Worrell
(74) *Attorney, Agent, or Firm*—Notaro & Michalos P.C.

(57) ABSTRACT

A known one-cylinder small-diameter circular knitting machine for production of sock goods is modified for closing the toe directly in the machine, where the initial rows of the knitwear beginning by reciprocal knitting of toe pouch are knitted on one half of needles 1, into which needles 1 elastic thread S drawn from a bobbin C is inserted by a thread guide 2. The machine is further provided with a plate brake 3, which plate brake 3 is placed in the path of the elastic thread E in front of the thread guide 2. In front of the plate brake 3 a controlled blocking brake 4 is then positioned in the path of the elastic thread E. In front of the blocking brake 4 a positive feeder 5 is positioned.

6 Claims, 2 Drawing Sheets

METHOD AND DEVICE OF CONTROLLING ELASTIC THREAD

FIELD OF THE INVENTION

The present invention relates to the method of controlling elastic thread laid in knitting, particularly of the initial row of a closed toe by reciprocal movement in small-diameter knitting machine for production of sock goods and a device for carrying out this method.

BACKGROUND OF THE INVENTION

It is known that in small-diameter knitting machine for production of hosiery or sock goods highly elastic knitting material is introduced to the knitwork, for example rubber covered by natural or synthetic materials. This yarn is fed to needles positively by known thread feeders.

Also, at the start of the closed toe knitting method directly on the machine, this elastic thread is fed during the reciprocal movement of the needle cylinder during the make-up, which needle cylinder executes a greater swing than what represent the knitting needles for technological reasons. The elastic yarn is introduced through a known tensioning device, which tensioning device extracts this yarn in stretched state off the knitting needles during the reverse swing of the needle cylinder and then the tensioning device feeds the yarn again into the knitting feed during knitting. When the feeding of elastic yarn is finished, the yarn is captured by controlled holder and cut off by fixed knife.

A disadvantage of this configuration is that for every knitting feed it is necessary to have a controlled holder and a knife, what, when a greater number of fed elastic yarns is required, puts high demands on positioning of the holder and the knife on the dial. Another disadvantage is high demand on design of the tensioning device, which tensioning device is required to reliably compensate tension in the elastic yarn.

It is an object of this invention to remove said disadvantages by a simple method.

SUMMARY OF THE INVENTION

The method of controlling elastic thread laid in knitting, particularly that of the initial row of a closed toe, by reciprocal movement in small diameter knitting machine for production of sock goods according to this invention is characterized in that in the interval after passing of the last knitting needle in one direction of turning around a thread guide and before the last knitting needle gets to a dead point, the elastic thread laid is braked and halted, and during the reverse passing of this needle around said thread guide it is braked off and after lifting of the thread guide laying the elastic thread into the non-working position it is positively fed into the thread guide up to the moment of cutting it off and catching it in the pneumatic nozzle of the machine.

A device for carrying out the method according to the present invention is characterized in that it comprises a computer controlled brake of said elastic thread and of a positive feeder.

Preferably, said controlled brake of said elastic thread is put behind said thread guide for laying of said elastic thread in front of said positive feeder.

BRIEF DESCRIPTION OF THE DRAWINGS

The invention in its various aspects will now be described with reference to certain drawings thereof, in which.

BEST MODE FOR CARRYING OUT THE INVENTION

Figure 3:
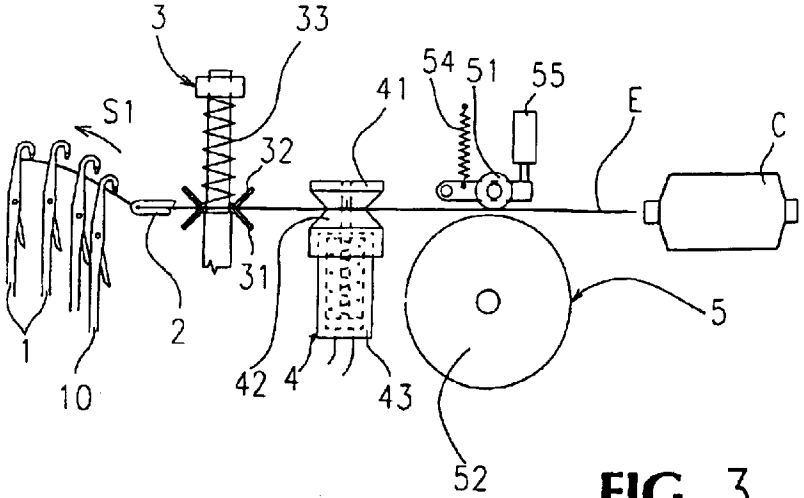
FIG. 3 shows the same as FIG. 2 but in an interval when the elastic thread is carried away by the last knitting needle into the dead point.

A known one-cylinder small-diameter circular knitting machine for production of sock goods is adapted for toe closing directly in the machine, where the initial rows of a knitwear starting with reciprocal knitting of toe pouch are knitted on one half of the needles 1 into which needles 1 elastic thread E drawn from a bobbin C is introduced by a thread guide 2. The machine is further provided with a plate brake 3, which plate brake 3 is placed in the path of the elastic thread E in front of the thread guide 2. In front of the plate brake 3 a controlled blocking brake 4 is then positioned in the path of the elastic thread E. In front of the blocking brake 4 a positive feeder 5 is positioned.

Figure 2:
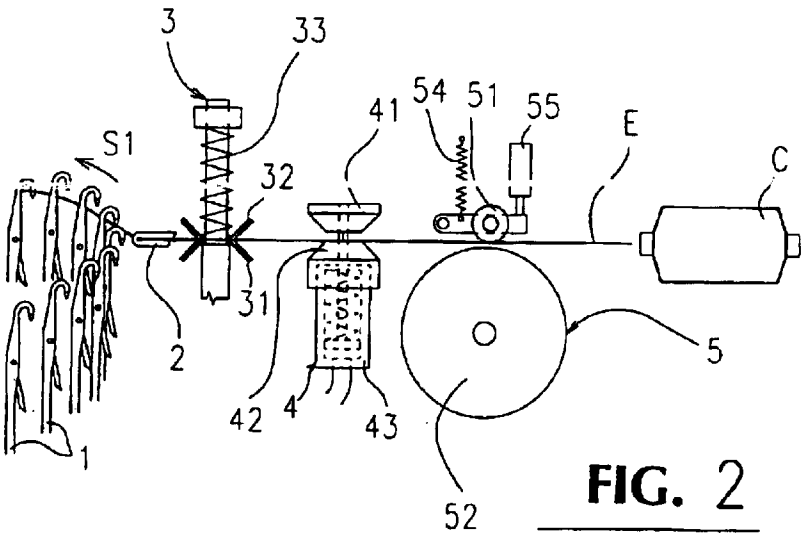
FIG. 2 shows a schematic view of the working position of the means for feeding the elastic thread in one direction of turning the needles.
Figure 7:
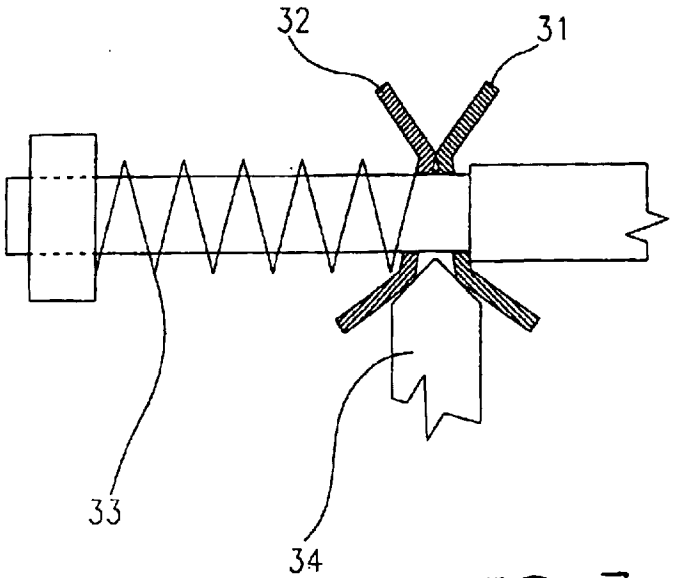
FIG. 7 shows a detail of the thread brake, which thread brake is positioned in front of the elastic thread guide.

The plate brake 3 consists of the first plate 31 and the second plate 32 (see FIG. 7) and a compression spring 33 acting on them. In the nonworking position an opener 34 fixed on thread guide 2 extends in between the plates 31 and 32. The blocking brake 4 comprises a third plate 41 and a fourth plate 42 (see FIG. 2), whereby, the third plate 41 is pneumatically controlled by a pneumatic cylinder 43. The pressure air supply is controlled by a controlling computer of the machine by means of a valve. The positive feeder 5 comprises the first feeding disc 51 and the second feeding disc 52, of which the first disc 51 is compressive and it is placed on a lever 53, which lever 53 is controlled by an extension spring 54 and by a pneumatic cylinder 55, which pneumatic cylinder 55 is again controlled by a controlling computer of the machine, again by means of a valve.

Further, the machine is provided with a known not shown cutting and holding device comprising a circular cutting saw with an assigned fixed knife and a pneumatic nozzle with suction effect for holding the non-working thread ends.

The method how the laid elastic thread E is handled during the reciprocal knitting of the beginning of the closed toe is as follows: The positive feeder 5 is out of activity, therefore, the extension spring 54 holds the first feeding disc 51 above the second feeding disc 52. The needle cylinder performs movement in the direction of arrow S1. The elastic thread E is introduced into the working needles 1 through the closed plates 31 and 32, which plates 31 and 32 exert the required tension in the elastic thread E by the action of the compression spring 33, whereby, the plates 41 and 42 of the blocking brake 4 are apart of each other, and also the compression feeding disc 51 is in the non-working position, so as it can be seen in FIG. 2. Before the last working needle 10 (FIG. 3) from the working half-arch of needles 1 producing the toe pouch gets to the dead point, the plate 41 is moved to the plate 42 by a command of the controlling computer by means of a spring of the pneumatic cylinder 43 and the elastic thread E is completely braked, so as it can be seen in FIG. 3. During further turning of the needle cylinder, the braked elastic thread E is elongated by the last working needle 10 up to the dead point.

Figure 4:
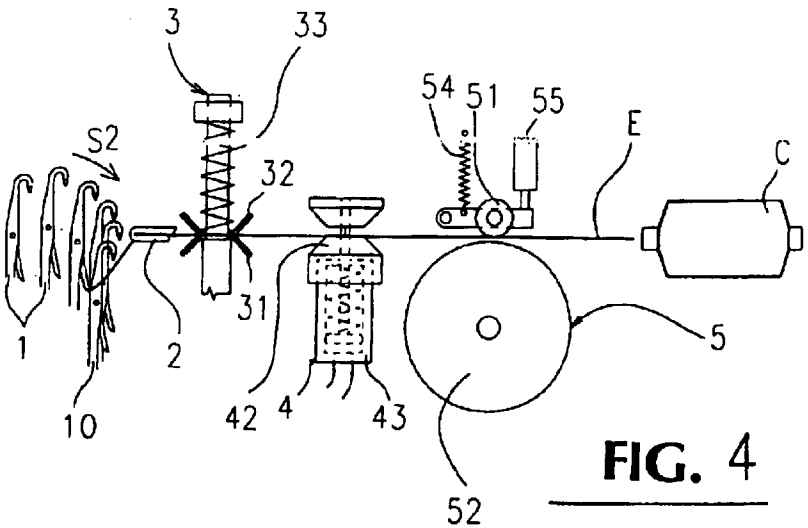
FIG. 4 shows the same as FIG. 2 but the needles are turning the other way round and in the moment when the first working needle with the elastic thread passes round the thread guide.
Figure 1:
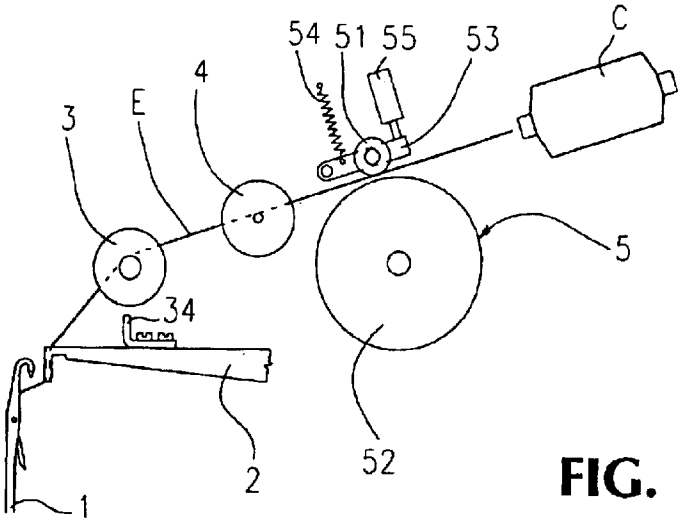
FIG. 1 shows a schematic view of the means for feeding the elastic thread into needles.
Figure 5:
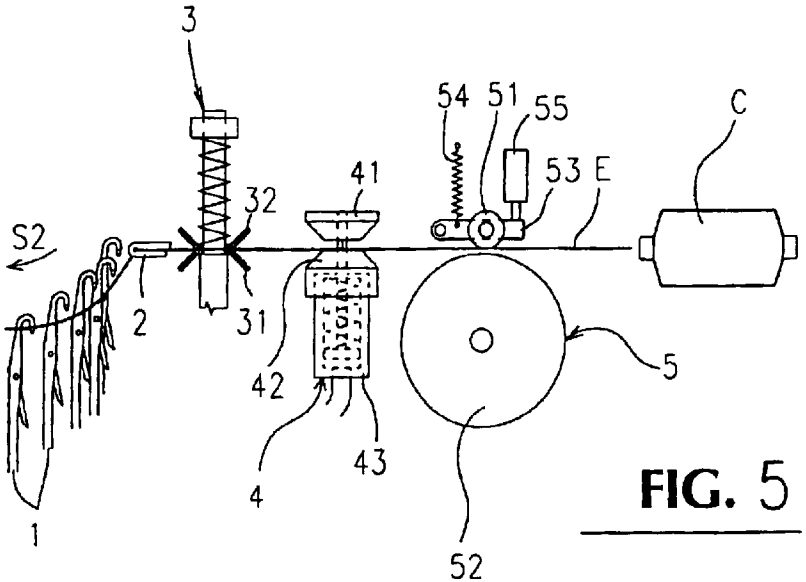
FIG. 5 shows the same as FIG. 3 but in the other direction of turning.

During the following reverse swing of the needle cylinder in the direction of arrow S2 (see FIG. 4) the elastic thread E is still braked and by the action of its elasticity, it is still held in tensioned state in the space between the thread guide 2 and the needle 10, which needle 10 is now the first which will subsequently knit. At the moment, when the first needle 10 carrying the elastic thread E in the direction of arrow S2, so as it is apparent in FIG. 4, passes the thread guide 2, the plates 41 and 42 are opened by means of a command of the controlling computer and the elastic thread E is knitted by needles 1 in this direction of turning so as it can be seen in FIG. 5. The moment when the needle 10 passes the thread guide 2 is to be understood the angle corresponding to the range of several needles when this can happen, it is not meant exactly in relation to a needle. Before the dead point, the plates 41 and 42 are again compressed and then the whole cycle of handling with the elastic thread E is repeated so as it was described, but in the opposite direction of turning.

This alternating of compressing and opening of the plates 41 and 42 is repeated in relation to the reciprocal movement of the needle cylinder in accordance with the requirement on the number of swings in which it is necessary to have the elastic thread E knitted in. To finish the knitting in of the elastic thread E it is necessary to produce a pre-stock of untensioned elastic thread E, so that after it is cut off a sufficiently long end of the cut off free elastic thread E remains, which is then held together with other threads in the suction nozzle by pneumatic effect, what takes place subsequently.

Figure 6:
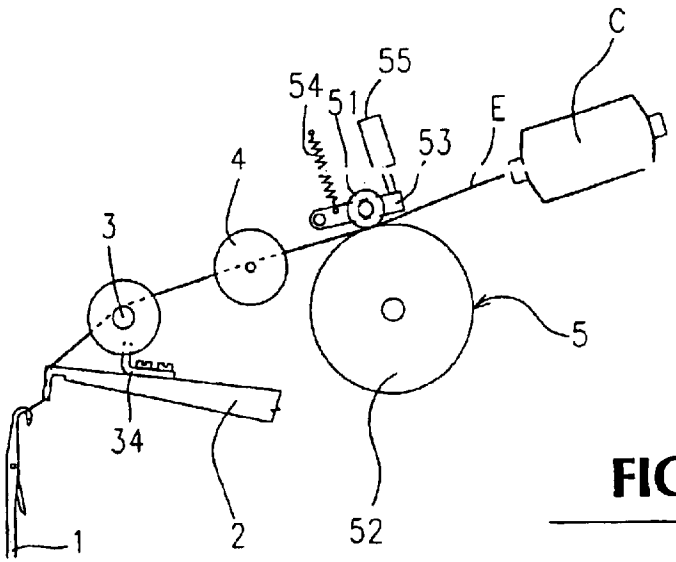
FIG. 6 shows schematically the lifted position of the thread guide with elastic thread where the positive feeder is in function.

Sufficiently ahead of the cutting off time, the thread guide 2 is taken into the non-working position in the direction of arrow S1 during introducing so as it is apparent in FIG. 6. Because of this, the opener 34 moves between the plates 31 and 32, which plates 31 and 32 open and the elastic thread E is then braked off, whereby, the brake 4 is also put out of function by a command of the controlling computer, and the plates 41 and 42 remain apart from each other.

By a command of the controlling computer, the pneumatic cylinder presses the feeding disk 51 to the feeding disc 52 by means of lever 53 and the elastic thread E starts to be positively fed into the machine, particularly the thread guide 2, and from this thread guide 2 the elastic thread E is being pulled by the saw of the cutting device up to the moment when it is cut off. By this feeding, pre-stock of untensioned elastic thread E is formed between the thread guide 2 and the fixed knife of the cutting device before cutting off, and the free end of the elastic thread E is then safely sucked in by the nozzle after the cutting off.

What is claimed is:

1. A method of controlling elastic thread laid in knitting by reciprocal movement in a small diameter knitting machine for production of sock goods, comprising: leading an elastic thread (E) to the knitting machine; during an interval after passing of a last knitting needle (1) in one direction of turning of a thread guide (2) and before the last knitting needle (1) reaches a dead point thereof, braking and halting the leading of the elastic thread; during a reverse passing of the last knitting needle (1) around the thread guide (2), braking off the elastic thread; lifting the thread guide (2) for laying the elastic thread into a non-working position; thereafter positively feeding the elastic thread into the thread guide (2) up to a moment of cutting off the elastic thread; cutting off the elastic thread at the moment of cutting off; and catching the cut off elastic thread in a pneumatic nozzle of the knitting machine.

2. A method according to claim 1, comprising using a computer to control a brake (4) for breaking the elastic thread (E) and for controlling a positive feeder (5) for positively feeding the elastic thread.

3. A method according to claim 2, including placing the controlled brake (4) of the elastic thread (E) behind the thread guide (2) for laying the elastic thread (E) in front of the positive feeder (5).

4. A device for controlling elastic thread laid in knitting for reciprocal movement in a small diameter knitting machine for production of sock goods, comprising: means for leading an elastic thread (E) to the knitting machine; a thread guide (2) for guiding the elastic thread; a controlled brake (4) positioned with respect to the thread guide so that during an interval after passing of a last knitting needle (1) of the knitting machine in one direction of turning of the thread guide, and before the last knitting needle (1) reaches a dead position thereof, the controlled brake brakes and halts the leading of the elastic thread; means for braking off the elastic thread during a reverse passing of the last knitting needle (1) around the thread guide (2); means for lifting the thread guide (2) for laying the elastic thread (E) into a non-working position; a positive feeder (5) for positively feeding the elastic thread into the thread guide (2) after lifting of the thread guide and up to a moment of cutting off of the elastic thread; means for cutting off the elastic thread; and means for catching the cut off elastic thread in a pneumatic nozzle of the knitting machine.

5. A device according to claim 4, including a computer control for controlling the controlled brake (4) and the positive feeder (5).

6. A device according to claim 5, wherein the controlled brake (4) is behind the thread guide (2) in a laying direction of the elastic thread (E) for laying the elastic thread (E) in front of the positive feeder (5).

* * * * *